United States Patent [19]

Lane, Jr. et al.

[11] Patent Number: 4,890,744

[45] Date of Patent: Jan. 2, 1990

[54] EASY OPEN PRODUCT POUCH

[75] Inventors: William A. Lane, Jr., Lake Arrowhead; Steven D. Davis, Yuciapa, both of Calif.

[73] Assignee: W. A. Lane, Inc., San Bernardino, Calif.

[21] Appl. No.: 264,025

[22] Filed: Oct. 28, 1988

[51] Int. Cl.[4] ..... B65D 75/58

[52] U.S. Cl. ..... 206/632; 206/484; 206/634; 383/906; 222/92; 222/97; 222/107

[58] Field of Search ..... 206/634, 484, 484.2, 206/632, 634, 604, 601; 222/92, 94, 107; 383/100, 103, 906

[56] References Cited

U.S. PATENT DOCUMENTS

| | | | |
|---|---|---|---|
| Re. 24,251 | 12/1956 | Kaplan et al. | 222/107 |
| 2,103,389 | 12/1937 | Salfisberg | 206/629 X |
| 2,705,579 | 4/1955 | Mason | 222/107 |
| 2,976,988 | 6/1957 | Schneider | 206/484 X |
| 3,453,661 | 7/1969 | Repko | 206/484 X |
| 3,521,805 | 7/1970 | Ward | 206/484 X |
| 3,635,376 | 1/1972 | Hellstrom | 206/634 |
| 3,637,132 | 1/1972 | Gray | 383/100 |
| 3,917,116 | 11/1975 | Mason | 426/115 X |
| 3,924,745 | 12/1975 | Hanneman | 206/484 |
| 4,072,249 | 3/1978 | Ekenstam et al. | 222/107 X |
| 4,331,264 | 5/1982 | Staar | 222/94 |
| 4,717,046 | 1/1988 | Brogli | 206/484 X |
| 4,759,472 | 7/1988 | Strenger | 206/634 X |

FOREIGN PATENT DOCUMENTS

| | | | |
|---|---|---|---|
| 0078761 | 5/1983 | European Pat. Off. | 222/107 |
| 0713629 | 8/1954 | United Kingdom | 222/92 |
| 1014006 | 12/1965 | United Kingdom | 222/92 |

*Primary Examiner*—Jimmy G. Foster
*Assistant Examiner*—Kathryn M. Stemann
*Attorney, Agent, or Firm*—Herb Boswell

[57] ABSTRACT

An easy open pouch is formed from front and back thin films by a seal formed between the films. The seal defines a product storage chamber and a dispensing cavity between the films. The seal completely surrounds the product storage chamber. An opening to the exterior of the pouch is formed in the seal in the dispensing cavity. The product storage chamber and the dispensing cavity are located adjacent to one another with a common wall located between them. The common wall is formed as a part of the seal and is frangible in response to a pressure differential between the product storage chamber and the dispensing cavity. Upon creating a pressure differential between the product storage area and the dispensing cavity the seal across the common wall delaminates to join the product storage chamber to the dispensing cavity. Product can then be dispensed from the product storage chamber through the dispensing cavity and out of the dispensing cavity opening.

2 Claims, 2 Drawing Sheets

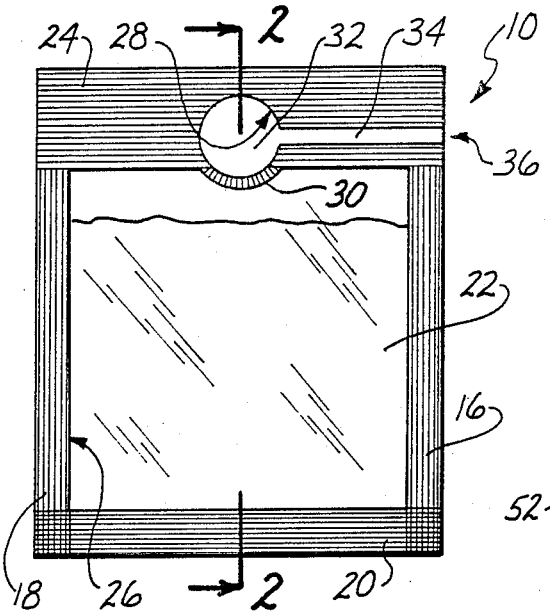
FIG. 1
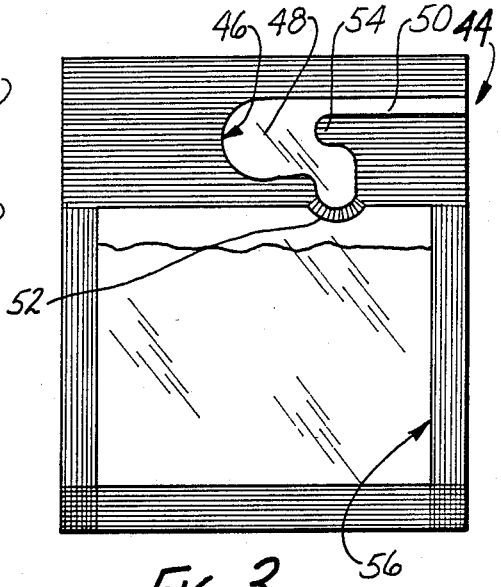
FIG. 3
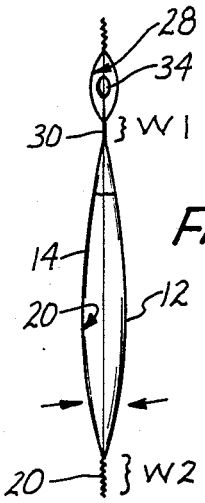
FIG. 2
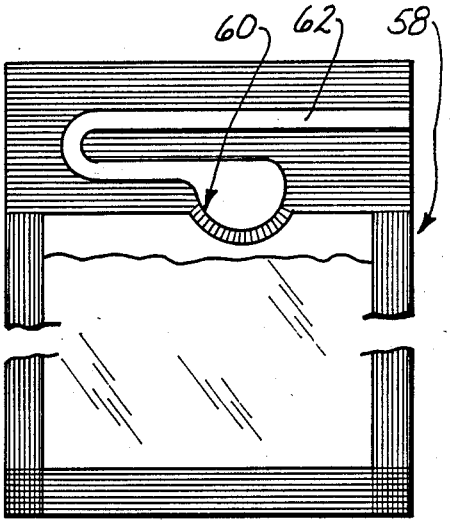
FIG. 4
FIG. 9
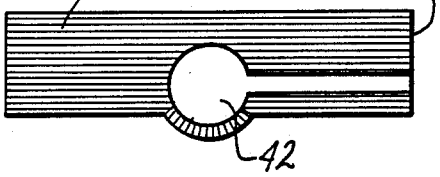

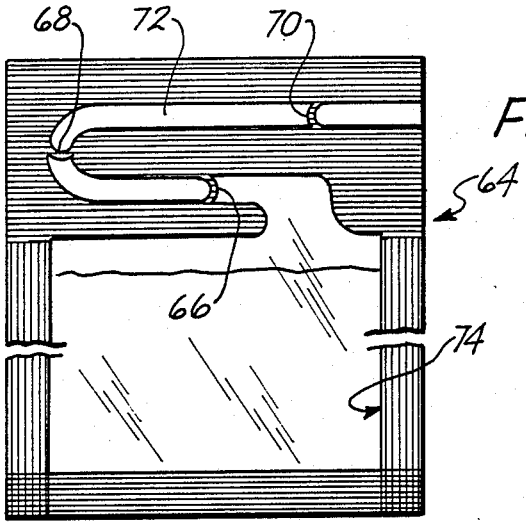
FIG. 5
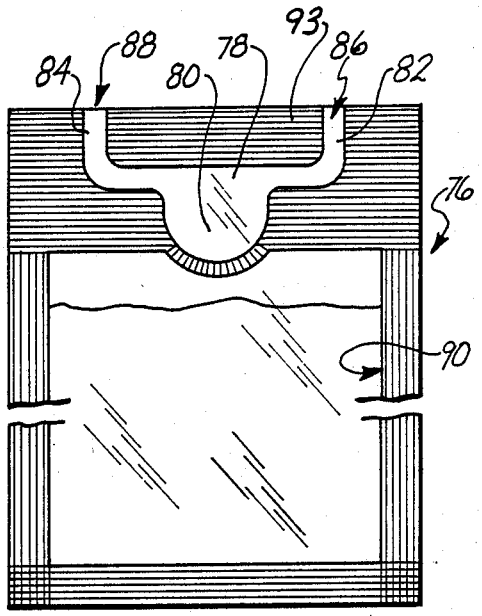
FIG. 6
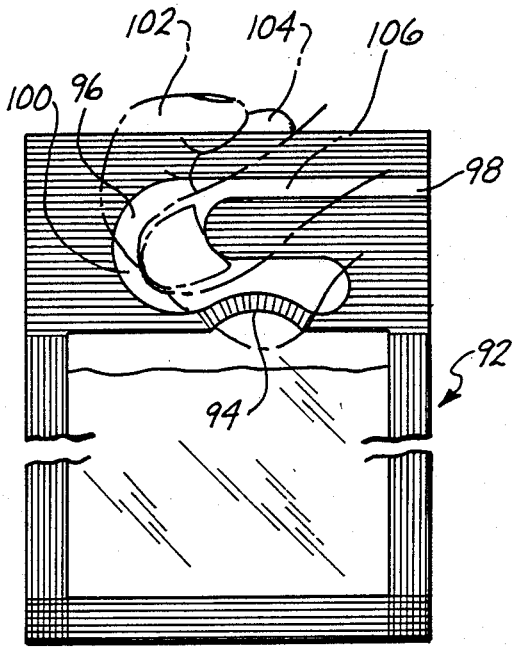
FIG. 7
FIG. 8
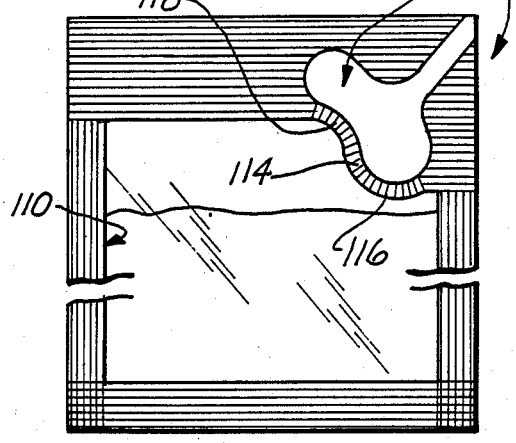

EASY OPEN PRODUCT POUCH

BACKGROUND OF INVENTION

This invention is directed to an easy open thin film pouch. Most particularly the invention is directed to a thin film pouch which has a pressure rupturable frangible seal formed between the film layers of the pouch.

A variety of pouches formed from thin films are used for storage and dispensing of products. A large majority of these products are liquid or semi liquid food stuffs and personal care items. Typically small quantities of food, condiments, salad oil or lemon juice are packaged in small pouches suitable for individual servings. Small pouches are also utilized for samples of personal care products such as lotions and soaps. Larger pouches are utilized to contain items normally utilized in larger quantities as, for instance soups, salad oils, sauces and other items utilized in bulk.

While thin film pouches can be opened utilizing a pair of scissors or a knife this is very inconvenient especially for individual serving pouches. Thus most pouches are manufactured to include a perforated area or a notched corner allowing for the user of the pouch to hold the pouch in one hand and rip or sever the pouch along the notch or perforated area. While this method of opening the pouch offers no problem to those individuals having two healthy hands, two hands which are currently free and/or two hands which are clear or dry, it can present problems to those not having two healthy hands, only one hand which is free or wet or greasy hands.

An individual, for whatever reason, having only one hand available to him or her for opening a pouch has difficulty opening pouches which require tearing or severing of a portion of a pouch about a notch or a perforated region on the pouch. This is an act which is extremely difficult if not impossible to do with only one hand. Further, in situations as, for instance, in a shower in attempting to open a pouch containing hair conditioner or other similar product, the user's hands are normally wet and it is all but impossible to get a proper grip on the small segment of pouch which must be torn away from the remainder of the pouch to open the pouch. Additionally, if an individual attempting to utilize the contents of the pouch has greasy or oily hands they also find it impossible to grip the small segment of the pouch which must be torn or severed from the remainder of the pouch.

Not being able to easily open a pouch can lead to frustration and thus dissatisfaction with the product which is contained in the pouch.

BRIEF DESCRIPTION OF THE INVENTION

In view of the above it is a broad object of this invention to provide for easily opened pouches of the type formed from thin films. It is a further object of this invention to provide for pouches which are constructed such that they are capable of being opened with a single hand.

These and other objects as will become evident from the remainder of this specification are achieved in a pouch formed from thin film which includes having front and back films sealed together about juxtaposed portions of the respective films. This seal defines a product chamber (which is initially sealed), a dispensing cavity and a control means for first isolating and then subsequently connecting the dispensing cavity to the product chamber. The product chamber forms a product reservoir for storage of a product within the pouch. The dispensing chamber includes an opening to the exterior of the pouch for dispensing the product from the pouch. The control means, located in association with both of the product chamber and the dispensing chamber, first forms a temporary barrier between the product chamber and the dispensing chamber and then further subsequently connects the product chamber to the dispensing chamber for transferring of product from the product chamber through the dispensing chamber and out of the dispensing cavity opening.

In an embodiment of the invention the control means is formed as a temporary frangible seal between the front and back films. This frangible seal is located between the product chamber and the dispensing chamber. The frangible seal may be formed as a projection having a convex side and a concave side. One of the convex or concave sides will be located within the product chamber and the other in the dispensing chamber. Preferably the projection is shaped as a radius of curvature.

The control means may further comprise a plurality of temporary seals between the respective films with at least one of these temporary seals initially forming a portion of a continuous seal between the respective films. This continuous seal circumscribes and defines the product chamber. The remainder of the temporary seals are then further located in the dispensing cavity.

The objects of the invention are further achieved in a pouch formed of front and back thin films having a seal formed between these films. The pouch includes a product storage chamber which is defined by a first continuous portion of the seal which circumscribes an area of the pouch. Within this area the front and back films are not sealed together. Further, the pouch includes a frangible area located in the first portion of the seal. The seal along the frangible area is capable of being severed to delaminate or disjoin the front and back films in the frangible area. Further, the pouch includes a dispensing cavity defined in part by a further portion of the seal and in part by the frangible area of the first portion of the seal. As such the frangible area serves as a temporary common wall between the product chamber and the dispensing cavity. The dispensing cavity further includes an opening to the exterior of the pouch for dispensing product from the pouch.

The objects of the invention may further be achieved in a pouch formed from a first and second layer of a thin film which has a continuous seal formed between the first and second layers. A first portion of this seal surrounds a first void area between the first and second layers of film. This first void area is utilized for storing a quantity of a product in the pouch. A second portion of the seal surrounds a second void area between the first and second layers of this film. The second void area includes an opening through the seal to the exterior of the seal. A further portion of the seal is formed as a common seal portion between the first and second void areas. The common seal portion is capable of being ruptured or severed in response to a pressure differential between the first and second void areas. Upon rupturing of the common seal the films are delaminated or separated apart from one another at the area of the common seal which joins the first and second void areas together.

Preferably to form the rupturable area of the common seal, i.e. the frangible seal or area of the seal about which the films delaminated from one another, the shape of this area of the seal is formed to included a projection or curved wall. As so formed when pressure is applied to the area of the seal which is curved, the first and second films will preferentially delaminate or separate along the curved area of the seal.

BRIEF DESCRIPTION OF THE DRAWINGS

This invention will be better understood when taken in conjunction with the remainder of the this specification and the drawings wherein:

FIG. 1 is a plan view of an illustrative pouch of the invention;

FIG. 2 is a side elevational view about the line 2—2 of FIG. 1;

FIG. 3 is a plan view of an additional illustrative pouch of the invention;

FIG. 4 is a plan view of an additional illustrative pouch of the invention;

FIG. 5 is a plan view of an additional illustrative pouch of the invention;

FIG. 6 is a plan view of an additional illustrative pouch of the invention;

FIG. 7 is a plan view of an additional illustrative pouch of the invention taken in conjunction with the two digits and the thumb of a user's left hand shown in a position they would be in during opening of the pouch of the figure;

FIG. 8 is a plan view of an additional illustrative pouch of the invention; and

FIG. 9 is a plan view of a head seal utilized to form the illustrative pouch of the invention seen in FIG. 1.

This invention utilizes certain principles and/or concepts as are set forth in the claims appended to this specification. Those skilled in the arts to which this invention pertains will realize that these principles and concepts are capable of being utilized in a variety of embodiments which may differ from the illustrative embodiments utilized for descriptive purposes of this specification. For this reason this invention is not to be construed as being limited solely to the illustrative embodiments, but should only be construed in view of the claims appended hereto.

DETAILED DESCRIPTION OF THE INVENTION

A variety of different configurations of pouches of the invention are shown in the Figures. These various pouch configurations, however, all share certain common properties of the invention.

The pouches of the invention are generally what are considered as "form, fill and seal" pouches. These pouches are formed on a pouch "form, fill and seal" machine from continuous rolls of thin film. To form a pouch a front and back film are sealed or laminated together along the sides and the bottom, the pouch is then filled with product and then the top of the pouch is sealed. Sealing of the top of the pouch takes place concurrently with sealing of the bottom of a next pouch descending on the "form, fill and seal" machine. This process is generally as is described in U.S. Pat. Nos. 4,768,330 and 4,769,974. The pouches of the invention would be formed on a machine as is described in those patents in an analogous manner as to that described in those patents with the exception that the head seal (as is described in those patents) would be constructed to accommodate the forming of the appropriate seals, as hereinafter described between the films, which define the structure of the pouches of the invention.

FIG. 1 shows an illustrative pouch 10 of the invention. The other figures show other illustrative pouches of the invention as described below. For the purposes of brevity of this specification, certain of the features described for the pouch 10 which are common to other illustrative pouches of the other figures will only be described with respect to the pouch 10, it being understood that unless otherwise noted the other illustrative pouches of the other figures would be constructed in a like manner.

In forming the pouch 10 on a "form, fill and seal" machine, a front film 12 and a rear film 14 are sealed together along right side edge 16 and left side edge 18. The pouch 10 is then sealed along its bottom edge 20 followed by adding an appropriate product to the three sided reservoir which now has been formed between the front and rear films 12 and 14. These side and bottom seals along with a top seal described below are formed by heat and pressure lamination of the front and rear films 12 and 14 together.

After filling of the pouch 10 with an appropriate aliquot of product 22 the pouch then is sealed along its top edge 24 and severed from the continuous advancing pouches formed from the front and rear films 12 and 14 on the "form, fill and seal" machine. The pouches of the invention are thus capable of being formed on commercially available "form, fill and seal" machines which are equipped with side seals and a head seal which are designed and constructed to form the appropriate seal patterns in the edges of the pouch.

While the right and left side edges 16 and 18, the bottom edge 20 and the top edge 24 are sealed during sequential sealing operations as the pouch 10 is formed on a "form, fill and seal" machine, after these edges are sealed, in essence, a continuous seal is formed between juxtaposed portions of the front film 12 and the rear film 14 which make up the pouch 10. The seal formed between the front and rear films 12 and 14 defines a product chamber or product reservoir 26 and further defines a dispensing cavity 28. The product chamber 26 and the dispensing cavity 28 are separated in part by a common "frangible" wall 30.

Including the common wall 30, the totality of the seal around the product chamber 26 is continuous after formation of the pouch 10. As such the product 22 which is packaged within the pouch 10 is protected from the environment against spoilage and contamination as per other thin film pouches. The common wall 30 serves as a temporary portion of a seal which circumscribes the product chamber 26 and protects the product 22 packaged therein. The common wall 30 is a temporary wall however, and is capable of being ruptured or broken, i.e. the films 12 and 14 delaminated from one another, by creating a pressure differential between the product chamber 26 and the dispensing cavity 28.

For the purposes of this specification and the claims appended hereto, the terminology "frangible" is defined to indicate the susceptibility of being broken without implying weakness, a defect of delicacy. Thus, in speaking of a temporary frangible seal between the films of pouches of the invention, it is meant that when so sealed the films are united together in a fluid impervious manner and when this seal is broken or severed by delamination of the films from one another in the area of the seal, the films are separated apart from one another severing the seal while still maintaining the integrity of the individual films themselves. Thus the films remain intact maintaining the films still essentially fluid impervious. The frangible seal in an intact state serves to maintain the integrity of the product chamber reservoir for maintaining fluid or semifluid products therein (as well as solid products if desired) but in a broken or severed state allows for passage of these products between the films along a delaminated seal area.

The dispensing cavity 28 is formed in the seal along the top edge 24 and includes a bulbous area 32 and a restricted area or conduit 34 which terminates as an opening 36. To define the opening 36 the seal along the right side edge 16 is incomplete such that at the opening 36, the front film 12 and the rear films 14 are not sealed together. Further, the front and rear films 12 and 14, respectively, are also not sealed together along the length of the conduit area 34 and the bulbous area 32 of the dispensing cavity 28. Thus, as with the product chamber 26, the dispensing cavity 28 is formed as a hollow or void area between the front and rear films 12 and 14.

The product chamber 26 can be considered as a first area formed between the front and back films 12 and 14 and the dispensing cavity 28 as a second area between the front and rear films 12 and 14. These first and second areas are initially separated from one another by a common seal portion, i.e. the common wall 30 but later can be joined to one another by film delamination within the common wall 30.

The top edge 24 of the pouch 10 would be formed utilizing a head seal of a configuration as seen in FIG. 9. FIG. 9 shows one of two head seals which would be utilized for forming the pouch 10 of FIG. 1. In FIG. 9 the back head seal 38 is shown. It would be utilized in conjunction with a front head seal (not separately shown or identified) which mimics or forms a mirror image of the back seal 38. The seal 38 and its mating front seal would form a complete head seal utilized in a manner as is described in the above referenced U.S. Pat. Nos. 4,768,330 and 4,769,974 for forming pouches on "form, fill and seal" machines.

The head seal 38 includes knurled areas 40 which surround a hollow area 42. In forming the pouch 10, the unseen front head seal and the back head seal 38 are brought together against the front and rear films 12 and 14 heating and squeezing the films in a normal manner to seal, i.e. laminate, the films together. Because of the void or hollow area 42 in the back head seal 38, the front and rear films 12 and 14 are not joined in this area. Thus the unjoined area defines the dispensing cavity 28 in the pouch 10.

For illustrative purposes herein all of the necessary laminations patterns which define the common wall and the dispensing cavity 28 are shown in the top edge 24 of the pouch 10 of FIG. 1. While it is presently preferred to form these lamination patterns in the top edge it is understood that these patterns could be located in other of the edges of the pouches of the invention.

The pouch 10 is formed with a built in failure point, i.e. an area wherein the films 12 and 14 will delaminated from one another, in the seal which surrounds the product chamber 26. This built in failure point is at the common wall 30. At this one area, a delamination control area, the seal is weaker, i.e. more susceptible to delamination, than in other areas of the seal which surround the product chamber 26.

It has been found that by forming the common wall 30 as an inwardly projecting wall within the product chamber 26, rupture of the common wall 30 in response to applying pressure to the product chamber 26 is augmented. Correspondingly the side of the common wall 30 which is located within the dispensing cavity 28 projects outwardly from the dispensing cavity 28. Stated in other terms, the common wall 30 within the product chamber 26 is convex and within the dispensing cavity 28 is concave. Preferably the common wall is shaped as a radius of curvature. This geometry is utilized to facilitate ease of opening of the pouches of the invention and, as will be described below, in pouches of the invention wherein it is desirous to open the pouch by applying pressure to the dispensing cavity, the geometry is reversed.

In addition to shaping the common wall to project into an area wherein the pouch will be pressurized during opening, delamination along the common wall can further be facilitated by forming the width of the seal at the common wall 30 narrower than the width of the seal anywhere else around the product chamber.

In the pouch 10 the seal along the common wall 30 is of a width, as measured in the plane of the front and rear films 14, which is narrower than the width of the seal around the product chamber 26 anywhere else along the periphery of the product chamber 26. Thus, as can be seen in FIG. 2, the width W1 at the common wall 30 is less than the width W2 along the seal at the bottom edge 20.

Having purposely formed a frangible area in the seal surrounding the product chamber 26 at the common wall 30 of the pouch 10, if pressure is applied to the product chamber as per the arrows seen in FIG. 2 on the right and left hand sides of the product chamber 26, since the product chamber 26 is completely surrounded by a seal, pressure transferred to the product chamber 26 by the user of the pouch 10 is exerted all along the periphery of the seal surrounding the product chamber 26. Since the common wall 30 projects into the product chamber 26 and in conjunction with the width of the seal about common wall 30 being narrower than the width of the seal at any other place around the periphery of the product chamber 26, if the seal between the front and rear films 12 and 14 is to fail and the films 12 and 14 delaminate from one another, this will happen at the area of the common wall 30 before it happens at other areas of the seal which surround the product chamber 26.

To further facilitate the films 12 and 14 delaminating at the common wall, for the pouch 10 of FIG. 1 the head seal 38 is constructed such that its knurls essentially extend radially across the common wall from the center of the dispensing cavity 28 toward the product chamber 26, that is they are essentially perpendicular to the common wall at every point they cross the common wall. In response to pressure applied to the seal along the common wall, any initial delamination of the films 12 and 14 along the knurled patterns is propagated along the direction of the knurls radially towards the dispensing cavity from the product chamber.

The pouches of the invention are opened by applying pressure to one or the other of the product chamber or the dispensing cavity. If it is desirous to open the pouch of the invention by applying pressure to the product chamber 26, the product chamber side of the common or frangible wall is preferably formed as a convex wall and the dispensing side of the this wall is formed as a concave wall. If it is desirous to open the pouch of the invention by pressuring the dispensing cavity 28 the side of the common wall located within the dispensing cavity 28 will be convex and that within the product cavity 26 would be concave.

To open the pouch 10 of FIG. 1 the user simply applies pressure to the product chamber 26 elevating the pressure of the product chamber 26 with respect to that of the dispensing cavity 28 such that the films 12 and 14 about the common wall 30 delaminated or separate from one another to join the product chamber 26 to the dispensing cavity 30. Thus, the pouch 10 is opened with response to pressure applied thereto. The same principle would be utilized in a like manner to open the other pouches of the invention as hereinafter described.

Since the pouches of the invention are designed for mass distribution, it is evident that varying pressures will be utilized by varying individuals to open the pouches. It is evident that if the pouch 10 is opened in a very forceful manner the films 12 and 14 at the seal at the common wall 30 can be separated very abruptly and consequently product 22 from the product chamber 26 might be propelled out of the product chamber.

The dispensing cavity 28 serves to contain the initial product 22 which can be forcefully propelled from the product chamber 26 when the seal at the common wall 30 is broken by pressure. Upon severing of the seal at the wall 30 any initially forceful discharged of the product 22 is into the bulbous area 32 of the dispensing chamber 28 and contained therein. Once the seal of the pouch 10 is broken by the initial pressure surge applied to the product chamber 26 the contents of the product chamber 26 can be slowly discharged by continuous pressure to squeeze the product 22 from the product chamber 26 into the dispensing cavity 28 and then through the conduit area 34 out of the opening 36.

The dispensing cavity 28 serves to accept and mitigate the initial propelling force of the product from the product chamber 26 and retains any product propelled by this initial force preventing it from splashing, squirting or otherwise uncontrollably discharging from the pouch 10. In opening the pouch 10 an initial squeeze of the product chamber 26 within one hand of the user of the pouch 10 first opens the seal along the common wall 30 and then further squeezing allows for controlled dispensing of the product 22 from the opening 36.

Depending upon the product utilized within the pouches of the invention different configurations of the dispensing cavity can be selected. If the product is somewhat viscous as, for instance, catsup, the dispensing cavity 28 of the pouch 10 of FIG. 1 can be chosen. If the product is less viscous, of a more runny nature like lemon juice, a different configuration of the dispensing chamber can be selected.

In FIG. 3, a pouch 44 is illustrated which differs from the pouch 10 of FIG. 1 only with respect to the geometrical shape of its dispensing chamber. For this reason only the dispensing chamber of the pouch 44 will be described in detail with the remainder of the pouch 44 being identical to that of the pouch 10 of FIG. 1.

The dispensing chamber 46 of the pouch 44 as per the dispensing cavity 28 of the pouch 10, has a bulbous area 48 and a conduit area 50. The bulbous area 38, however, is set off to the side of a common wall 52. This forms an internal baffle 54 formed in part by the seal which seals the front and back films 12 and 14 together. When product, not separately identified or numbered, is initially ejected from the product chamber 56 of the pouch 44, it strikes the baffle 54 imparting a counterclockwise momentum to it. Since this counterclockwise momentum is away from the conduit 50, this better serves to initially contain a less viscous product within the dispensing chamber 46 upon opening of the pouch 44.

In FIG. 4 a further pouch 58 of the invention is illustrated. In this pouch the dispensing cavity 60 is formed with an elongated tortuous conduit 62. By lengthening and bending the conduit 62 compared to the straight conduits 34 or 50 of the pouches 10 or 44, the initial surge of a very nonviscous product upon opening of the pouch 58 is further inhibited.

A further pouch 64 of the invention is illustrated in FIG. 5. In the pouch 64 in place of having a single common wall, a plurality of frangible seals 66, 68 and 70 are formed in a tortuous conduit 72. The strength of the seals 66, 68 and 70 would be generally less than that described for the common wall 30 of the embodiment of FIG. 1 such that the seals 66, 68 and 70 individually would be easier to break but in combination form a barrier which must be sequentially overcome. Since the seals 66, 68 and 70 are formed as minimum seals one of them by chance could be severed during shipping or handling of the pouch 64, however, by providing a multitude of these easily severed seals, integrity of the overall seal of the pouch 64 is enhanced.

The pouch 64 is opened by also applying pressure to its product chamber 74 in a manner described above. This results in sequentially severing of the seals 66, 68 and 70 as the product is controllably moved through the conduit 72.

A further pouch 76 is illustrated in FIG. 6. In the pouch 76 the dispensing cavity 78 includes a bulbous area 80 which divides into two conduits 82 and 84 having respective openings 86 and 88. The pouch 76 serves to facilitate the dispensing of a product, as for instance, salad dressing which is spread over a large surface of a food stuff, i.e. the salad.

The pouch 76 further serves as an illustration of a pouch having a seal around the product chamber 90 which is continuous and a further portion of the seal in the area 93 (which divides the two conduits 82 and 84) which is disjoined from the remainder of the seal.

The pouches 10, 44, 58, 64, and 76 are all designed to be opened by applying pressure to the product chamber 26. In the pouch 92, illustrated in FIG. 7, the common wall 94 is inverted with respect to, as for instance, the common wall 30 of the pouch 10. That is it projects inwardly or is invaginated within dispensing cavity 96. This allows for opening of the pouch 92 by pressurizing the dispensing cavity 96.

The dispensing cavity 96 includes a conduit 98 which leads to a bulbous area 100 as per the embodiments of FIGS. 1 or 3. Because the wall 94 is convex into the bulbous area 100 the seal of this wall is delaminated by pressurizing the bulbous area 100. This is achieved by grasping the pouch 92 such that the digits of the user's hand are below the pouch as can be seen in phantom line wherein the index and middle digits 102 and 104 of the users left hand are shown. The user then positions the users left thumb, shown in phantom at numeral 106, on top of the pouch 92. Initially the thumb 106 in conjunction with the middle digit 104 seals off the conduit 98. By rolling the thumb forward onto the digit 102 the seal of the conduit 98 is maintained, however the bulbous area 100 is pressurized to sever the common wall 94 opening the pouch 92.

A further pouch 108 shown in FIG. 8 is designed for opening either by pressurizing its product chamber 110 or its dispensing cavity 112. A serpentine wall 114 extends between the chamber 110 and the cavity 112. The serpentine wall 114 thus includes an area 116 which is convex into the chamber 110 and concave with respect to the cavity 112 and an area 118 which is convex into the cavity 112 and concave with respect to the chamber 110. As a result pressure applied to the chamber 110 tends to delaminated the front and back films from each other along the serpentine wall 114 at the area 116 and pressure applied in the manner as per the pouch 92 to the cavity 112 tends to delaminated the front and back films from each other along the serpentine wall 114 at the area 118.

Delamination of the front and back films at the common walls is facilitated by the shape of the common wall. Further it is facilitated by the thickness of the common wall and the knurl pattern across the common wall. Typically the common walls between the respective product chambers and dispensing cavities of the various embodiments of the invention are of a width no greater than 0.0125 inches and the remainder of the seals around the product chambers are typical of a width of 0.25 inches to facilitate delamination of the film at the common walls with respect to the seal around the remainder of the product chamber.

To further augment delamination of the front and back films at the common walls without breakage of the front and rear films during delamination, high tensile strength films as, for example a biaxially oriented film, are preferred for use as the films 12 and 14. Such high tensile strength films are commercially available as for example Hercules or Mobil biaxial propylene films and Embyln biaxial nylon film.

What is claimed is:

1. A pouch formed from thin film which comprises:

front and back films joined together about juxtaposed portions of said front and back films to form (1) an initially sealed product chamber, (2) a dispensing cavity, and (3) a control means for first isolating and subsequently connecting said dispensing cavity and said product chamber;

said product chamber forming a product reservoir for storage of a product in said pouch;

said dispensing cavity having an opening to the exterior of said pouch for dispensing said product from said pouch;

said control means located in association with said product chamber and said dispensing cavity and first forming a temporary barrier between said product chamber and said dispensing cavity and further subsequently connecting said product chamber to said dispensing chamber for transferring said product from said product chamber through said dispensing cavity to said dispensing cavity opening;

said control means comprising a plurality of temporary seals between said front and back films;

at least one of said temporary seals initially forming a portion of a continuous seal between said front and back films; and said continuous seal circumscribing and defining said product chamber.

2. A pouch of claim 1 further including:

the remainder of said temporary seals located in said dispensing cavity.

* * * * *